US007946898B2

(12) United States Patent
Fukuda et al.

(10) Patent No.: US 7,946,898 B2
(45) Date of Patent: May 24, 2011

(54) METHOD FOR PRODUCING DIELECTRIC LAYER FOR PLASMA DISPLAY PANEL

(75) Inventors: Kazuto Fukuda, Osaka (JP); Kenji Date, Hyogo (JP); Yasuhiro Asaida, Kyoto (JP)

(73) Assignee: Panasonic Corporation, Osaka (JP)

( * ) Notice: Subject to any disclaimer, the term of this patent is extended or adjusted under 35 U.S.C. 154(b) by 238 days.

(21) Appl. No.: 12/464,440

(22) Filed: May 12, 2009

(65) Prior Publication Data

US 2009/0280714 A1 Nov. 12, 2009

(30) Foreign Application Priority Data

May 12, 2008 (JP) ..... P2008-124329

(51) Int. Cl.
*H01J 9/00* (2006.01)

(52) U.S. Cl. ..... 445/25; 445/24

(58) Field of Classification Search ..... 445/24, 445/25; 313/582–587
See application file for complete search history.

(56) References Cited

U.S. PATENT DOCUMENTS

| | | | | |
|---|---|---|---|---|
| 3,849,190 | A * | 11/1974 | Foster et al. | 445/24 |
| 5,703,437 | A * | 12/1997 | Komaki | 313/587 |
| 6,097,151 | A * | 8/2000 | Kim et al. | 313/586 |
| 2004/0102126 | A1 * | 5/2004 | Awaji et al. | 445/24 |

FOREIGN PATENT DOCUMENTS

| | | | |
|---|---|---|---|
| JP | 08013168 | A * | 1/1996 |
| JP | 08077930 | A * | 3/1996 |
| JP | 09199037 | A * | 7/1997 |
| JP | 2002-53342 | | 2/2002 |
| JP | 2003-518318 | | 6/2003 |
| JP | 2005-108691 | | 4/2005 |
| JP | 2007-109479 | | 4/2007 |
| WO | WO 0120637 | A1 * | 3/2001 |
| WO | 01/46980 | | 6/2001 |

* cited by examiner

*Primary Examiner* — Mariceli Santiago

(74) *Attorney, Agent, or Firm* — Wenderoth, Lind & Ponack, L.L.P.

(57) ABSTRACT

A method for producing a plasma display panel, a formation of the front-sided dielectric layer comprising the steps of: (i) locally supplying a low-melting point frit material onto a predetermined region of the substrate having the electrode thereon to locally form a low-melting point frit material layer; (ii) heating the low-melting point frit material layer to form a local glass layer therefrom; (iii) supplying a dielectric material over the substrate, covering the electrode and the local glass layer therewith to form a dielectric material layer; and, (iv) heating the dielectric material layer to form a dielectric layer therefrom, wherein a softening temperature of the local glass layer is lower than and equal to a softening temperature of a sealing material to be used for a panel sealing by which the front panel is sealed with a rear panel.

4 Claims, 7 Drawing Sheets

METHOD FOR PRODUCING DIELECTRIC LAYER FOR PLASMA DISPLAY PANEL

FIELD OF THE INVENTION

The present invention relates to a method for producing a plasma display panel. In particular, the present invention relates to a method for producing a dielectric layer provided in a front panel of a plasma display panel.

BACKGROUND OF THE INVENTION

A plasma display panel (hereinafter also referred to as "PDP") is suitable for displaying a high-quality television image on a large screen. Thus, there has been an increasing need for various kinds of display devices using the plasma display panel.

The PDP comprises a front panel and a rear panel opposed to each other. The front panel and the rear panel are sealed along their peripheries by a sealing material. Between the front panel and the rear panel, there is formed a discharge space filled with a discharge gas (helium, neon or the like).

The front panel is generally provided with a glass substrate, display electrodes (each of which comprises a scan electrode and a sustain electrode), a dielectric layer and a protective layer. Specifically, (i) on one of principal surfaces of the glass substrate, the display electrodes are formed in a form of stripes; (ii) the dielectric layer is formed on the principal surface of the glass substrate so as to cover the display electrodes; and (iii) the protective layer is formed on the dielectric layer so as to protect the dielectric layer.

The rear panel is generally provided with a glass substrate, address electrodes, a dielectric layer, partition walls and phosphor layers (i.e. red, green and blue fluorescent layers). Specifically, (i) on one of principal surfaces of the glass substrate, the address electrodes are formed in a form of stripes; (ii) the dielectric layer is formed on the principal surface of the glass substrate so as to cover the address electrodes; (iii) a plurality of partition walls are formed on the dielectric layer at equal intervals; and (iv) the phosphor layers are formed on the dielectric layer such that each of them is located between the adjacent partition walls.

In the PDP, the display electrode and the address electrode perpendicularly intersect with each other, and such intersection portion serves as a discharge cell. A plurality of discharge cells are arranged in the form of a matrix. Three discharge cells, which have red, green and blue phosphor layers in the arranged direction of the display electrodes, serve as picture elements for color display. In operation of the PDP, ultraviolet rays are generated in the discharge cell upon applying a voltage, and thereby the phosphor layers capable of emitting different visible lights are excited. As a result, the excited phosphor layers respectively emit lights in red, green and blue colors, which will lead to an achievement of a full-color display.

Recently, miniaturization of the discharge cells has been promoted by a demand for a higher definition of the PDP. However, a size reduction of the discharge cells leads to a decrease in emission brightness and thus an increase in power consumption. This is caused by a decrease in an opening ratio, a decrease in light emission time per picture element attributable to an increase in picture element number, a decrease in luminous efficiency or the like. As a method for increasing emission brightness, there has been proposed a method of increasing the opening ratio by decreasing the width of partition walls of the rear panel. However, even in this method, the emission brightness is still insufficient and a further improvement is required.

There has been proposed another method wherein a dielectric constant of a dielectric body in a front panel is decreased, and thereby reducing a reactive power upon discharge so as to improve the luminous efficiency. According to a formation of a front-sided dielectric layer in current method for producing PDPs, a dielectric material which contains glass powder with a size of several μms, an organic binder and a solvent is applied onto a glass plate by a known process such as screen printing process, die coating process or the like. Subsequently, a flat dielectric layer with high transmittancy is formed from the glass material by a drying step, a debindering step (300 to 400° C.) and a calcining step (500 to 600° C.). However, as for current dielectric materials, the glass powder tends to be melted at a low temperature, and thus a "material capable of decreasing a melting point of the glass (e.g. Bi)" is added thereto (see, for example, Japanese Patent Kokai Publication No. 2002-053342). Such material capable of decreasing a melting point of the glass has low purity and has a high dielectric constant of 10 or more. Although the dielectric constant can be decreased by adding other substances (e.g. alkali metal), a highly conductive metal such as silver is used as a main component in an electrode of PDP, and thus a diffusion and colloidization of the silver are promoted due to ion migration, which leads to an yellowing phenomenon in the dielectric body. The yellowing phenomenon has a great adverse influence on the optical characteristics of PDP.

In order to increase emission brightness by decreasing the dielectric constant of the dielectric layer, it is necessary to develop a new low dielectric constant material to replace current types of glass paste, and also develop a method of forming a dielectric layer using such material. As a process for forming a dielectric layer made of high-purity oxide, there has been a process in which a solid oxide is deposited on a substrate by sputtering process under vacuum atmosphere (i.e. sputtering deposition process), and also there has been another process in which a material is deposited by decomposing a raw material with plasma (i.e. chemical vapor deposition process). Although these processes can produce a dielectric layer with a high purity and a low dielectric constant, expensive vacuum facilities are required and a film-forming rate is so low as about several 100 nm per minute. In this regard, for preventing a dielectric breakdown phenomenon upon application of voltage, the required thickness of the dielectric film is usually 10 μm or more and thus the larger number of the equipments are required to increase a productivity thereof.

Alternatively, it has been proposed to melt silica with high purity. However, the melting of such silica is not practical since a high temperature of 1000° C. or higher is required.

As a process for forming a dielectric layer with low dielectric constant while ensuring productivity, there has been proposed a sol-gel process. According to this process, a metal alkoxide is hydrolyzed in a solvent to give a silicon compound and subsequently the silicon compound is subject to a condensation polymerization treatment by heating thereof to form a film which mainly consists of silicon oxide. For example, in a case where the silicon compound is a silicon hydroxide ($Si(OH)_4$), a network of —Si—O—Si— is formed by the following condensation polymerization reaction and thereby a solid $SiO_2$ is formed to give a dielectric layer.

$$n\mathrm{Si(OH)_4} \rightarrow n\mathrm{SiO_2} + 2n\mathrm{H_2O}$$

(n: an integer of 1 or more)

In a case where the silicon compound is a siloxane, a dielectric layer is formed by the following condensation polymerization reaction.

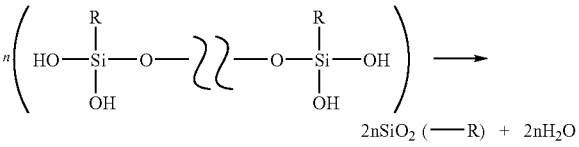

(R: alkyl group or hydrogen atom, n: integer of 1 or more)

According to the sol-gel process, a dielectric layer can be formed at a low temperature since no melting of the glass is required. However, a cracking phenomenon generally occurs in the dielectric layer as a result of a volume shrinkage thereof attributable to the condensation polymerization reaction. For this reason, it is generally difficult to form a thick film (e.g. film with about several μms). In this regard, particularly when the dielectric layer is formed over an electrode, a stress caused by volume shrinkage upon the condensation polymerization reaction is concentrated in the dielectric layer adjacent to the edge of the electrode. More specifically, a tensile stress applied to the dielectric layer by a substrate as a result of solidification attributable to the condensation polymerization reaction is concentrated adjacent to the edge of the electrode. As the display electrode of the front panel, a conductive layer mainly made of silver (i.e. bus electrode) is formed on an ITO electrode (i.e. transparent electrode) so as to decrease a resistance of the display electrode. When the dielectric layer is formed to cover the bus electrode, a stress attributable to the condensation polymerization reaction is concentrated adjacent to the edge of the electrode and thus a cracking of the dielectric layer occurs along edge of the electrode (see FIG. 6 and FIG. 7).

To cope with the cracking, there has been proposed a method for inhibiting the shrinkage by using an acid or base catalyst and a metal alkoxide with an organic functional group such as phenyl group, acryl group or the like (see, for example, Japanese Patent Kokai Publication No. 2005-108691). This method can form a thick dielectric layer. It is however possible in this method that a decomposition of the organic functional group is caused under a high-temperature atmosphere at about 400° C. This means that the cracking phenomenon may occur due to the volume shrinkage and thus it is impossible to guarantee quality in a high temperature step performed after the dielectric layer forming step.

Alternatively, there has proposed another method in which a dielectric layer is formed by calcining a dielectric material under an inert atmosphere at about 400° C. (see, for example, Japanese Patent Kohyo Publication No. 2003-518318). According to this method, the dielectric material is prepared by using a metal alkoxide with an organic functional group having a smaller molecular weight than that of the above organic functional group. Namely, the dielectric material is prepared by using a metal alkoxide with methyl group, ethyl group or the like. This method can form a layer with a thickness of 10 μm or more. However, according to this method, all steps after the dielectric layer forming step must be performed under an inert gas atmosphere, and thereby large facilities and strict control are required.

Alternatively, there has been proposed another method in which a stress release layer is formed between a dielectric material formed by a sol-gel process and a substrate (see Japanese Patent Kokai Publication No. 2007-109479). According to this method, a stress can be released in a dielectric layer by a difference in a thermal expansion coefficient, and thereby it is possible to form the dielectric layer with a small internal stress. However, the internal stress existing in the dielectric layer is not caused only by the difference in thermal expansion coefficient. Namely, most of the internal stress is due to a stress caused by the condensation polymerization reaction peculiar to the sol-gel process. Therefore, even if the stress release layer is provided, the condensation polymerization reaction may promote the cracking phenomenon to occur. Specifically, when a dielectric layer is formed by the condensation polymerization, a stress of the layer tends to be concentrated adjacent to electrode edge as a result of its volume shrinkage attributable to the reaction, and thus the cracking occurs in the dielectric layer along the edge portion of the electrode.

In this regard, it is possible that all the condensation polymerization reaction may not be completed even after the formation of the dielectric layer. In this case, when the dielectric layer is exposed to a higher temperature upon a subsequent panel sealing, the uncompleted condensation polymerization reaction proceeds and thus the cracking occurs along the edge portion of the electrode after the formation of the dielectric layer.

SUMMARY OF THE INVENTION

Under the above circumstances, the present invention has been created. Thus, an object of the present invention is to provide a method for producing a PDP dielectric layer, the method being capable of effectively preventing or reducing a cracking phenomenon which may occur upon the formation of the dielectric layer.

In order to achieve the above object, the present invention provides a method for producing a plasma display panel comprising a front panel wherein an electrode, a dielectric layer and a protective layer are formed on a substrate of the front panel, a formation of the dielectric layer comprising the steps of:

(i) locally supplying a low-melting point frit material (or "material that comprises a low-melting point glass frit") to a predetermined region of "substrate with the electrode formed thereon" to locally form a low-melting point frit material layer (or "low-melting point glass frit material layer");

(ii) heating the low-melting point frit material layer to form "local glass layer" from the low-melting point frit material layer;

(iii) entirely supplying a dielectric material onto "substrate with the electrode and the local glass layer formed thereon" to form a dielectric material layer; and (iv) heating the dielectric material layer to form a dielectric layer from the dielectric material layer, and wherein a softening temperature of "local glass layer" is lower than and equal to a softening temperature of "sealing material to be used for panel sealing by which the front panel is sealed with a rear panel".

The method of the present invention is characterized in that "local glass layer" and "entire dielectric layer" are formed on a substrate having an electrode formed thereon, and that a softening temperature of "local glass layer" is lower than and equal to a softening temperature of a panel sealing material.

As used in this specification and claims, "predetermined region" (to which "low-melting point frit material" is supplied) means a partial portion of "substrate region whereon an electrode formed". The predetermined region may be a plurality of partial regions of "substrate with an electrode formed thereon". In other words, the term "local" used in this specification and claims substantially means a limited partial region of "substrate with an electrode formed thereon". According to the present invention, there may be a plurality of such limited partial regions. Similarly, the term "local glass layer" used in this specification means a glass layer formed in the limited partial region of "substrate with an electrode formed thereon", and there may be provided a plurality of such local glass layers.

As used in this specification, the phrase "entirely supplying a dielectric material onto the substrate" means that the dielectric material is applied onto a substrate region that is larger than the predetermined region of "substrate with an electrode formed thereon". Preferably, the phrase "entirely supplying a dielectric material onto the substrate" means that the dielectric material is applied onto approximately the entire surface of "substrate with an electrode formed thereon". In short, the term "entire" used in this specification substantially means a substrate region that is larger than the above predetermined region.

In one preferred embodiment, the softening temperature of the local glass layer is higher than and equal to a solidification temperature of the dielectric material or a dielectric material layer. In other words, the softening temperature of the glass layer which has been formed locally on the substrate is higher than and equal to a heating temperature at which the dielectric material is solidified due to a condensation polymerization reaction.

In another preferred embodiment, the predetermined region onto which the low-melting point frit material is supplied in the step (i) is a local substrate region whereon an electrode is at least formed. Thus, the local glass layer is preferably formed such that it encases or encloses the electrode on the substrate. As used in this specification and claims, the term "electrode" means an electrode formed on a substrate of a front panel. For example, such electrode is a display electrode composed of a scan electrode and a sustain electrode. Each of the scan electrode and the sustain electrode is composed of a transparent electrode (i.e. electrode capable of transmitting visible light generated from the phosphor layer) and a bus electrode formed thereon (i.e. electrode capable of providing conductivity in the longitudinal direction of the transparent electrode, and thereby decreasing the resistance of the display electrode). It is preferred that "width Gx of the local glass layer" and "width Bx of the bus electrode" meet the condition: $1 \leqq Gx/Bx \leqq 2$. In this case, as described hereinafter, a desired balance is provided between "beneficial aspect wherein an occurrence of a cracking phenomenon is prevented by the glass layer" and "adverse aspect wherein a light transmittance is decreased by the glass layer".

In further another preferred embodiment, the resulting dielectric layer has a dielectric constant of 5 or less. Namely, the dielectric layer has a low dielectric constant, and consequently a generation efficiency of ultraviolet ray is improved so that a low power consumption of the PDP is achieved.

In accordance with the method of the present invention, the local glass layer can be softened upon a panel sealing since a softening temperature of the local glass layer is lower than and equal to a softening temperature of a sealing material used for the panel sealing. As a result, even if the temperature of the panel sealing causes an uncompleted condensation polymerization reaction to proceed additionally or concomitantly in the dielectric layer, a cracking which may be induced thereby can be effectively prevented by the softened local glass layer. Specifically, the softening of the local glass layer which encases or encloses the electrode can act as a cushioning material or a buffer material when a stress due to the uncompleted condensation polymerization reaction is generated in the dielectric layer adjacent to the electrode edge. In other words, even if the dielectric layer adversely undergoes the additional condensation polymerization reaction which may occur at a panel sealing temperature and higher (e.g. about 400° C. to 500° C.), the softened local glass layer can reduce a stress concentration caused by the dielectric layer shrinkage attributable to such additional reaction.

Particularly, when the softening temperature of the local glass layer is higher than and equal to a solidification temperature of the dielectric material, the occurrence of the cracking can be more preferably prevented by the following reason. The dielectric material itself preferably has a desired chemical composition capable of inhibiting the cracking phenomenon upon solidification (namely, the dielectric material has a preferred chemical composition which enables a relaxation of stress generated upon solidification). However, when the dielectric material is exposed to an excessive temperature higher than the solidification temperature thereof, the dielectric material can not maintain such desired chemical composition. Specifically, a desired dielectric material has a siloxane backbone to which an alkyl group (methyl group, ethyl group, etc.) is bonded. The alkyl group enables the stress generated upon solidification to be relaxed, thus making it possible to prevent the occurrence of cracking. However, when the dielectric material is heated at an excessive temperature higher than the solidification temperature thereof, the alkyl group is eliminated or released from the dielectric material. In accordance with the present invention wherein the softening temperature of the local glass layer is higher than and equal to the solidification temperature of the dielectric material, the occurrence of cracking can be effectively prevented by a buffer action of the softened glass layer, even if the alkyl group is eliminated or released.

The prevention of the cracking gives no "dielectric breakdown phenomenon" in the dielectric layer, which will lead to an achievement of high definition of the plasma display panel. Namely, the plasma display panel by the present invention has an improved panel lifetime.

The local glass layer can decrease a light transmittance due to an interfacial surface between the dielectric layer and the local glass layer wherein a refractive index of the dielectric layer is different from that of the local glass layer. In accordance with the method of the present invention, the local glass layer is substantially formed only on a bus electrode. Such bus electrode is a blackish electrode and thus the region above the bus electrode can not transmit light. Therefore, even if the local glass layer is disposed at such region, it substantially exerts no adverse effect on the light transmittance of the dielectric layer as a whole. In other words, in the method of the present invention, the glass layer with as small size as possible is formed at a limited local region so as not to substantially give an adverse influence on the light transmittance of the entire dielectric layer.

Therefore, in accordance with the method of the present invention, the occurrence of the cracking after the formation of the dielectric layer can be desirably inhibited by the local glass layer, while inhibiting a substantial decrease in the light transmittance of the dielectric layer caused by the glass layer. For this reason, the present invention makes it possible to satisfactory cope with a trade-off problem between "beneficial aspect wherein an occurrence of a cracking phenomenon is prevented by the glass layer" and "adverse aspect wherein a light transmittance is decreased by the glass layer".

With respect to the PDPs obtained by the present invention, the dielectric layer of the plasma display panel substantially has a satisfactory light transmittance as well as no physical defect (i.e. no cracking). The satisfactory light transmittance results in a desired brightness of the PDPS. And also, no physical defect results in a high resistance to the dielectric breakdown phenomenon, and thereby a higher definition of the plasma display panels can be achieved. In other words, even when a high voltage is applied, there is occurred no "dielectric breakdown phenomenon" in the dielectric layer, which will lead to an achievement of high definition of the plasma display panel.

In the method of the present invention, a sol-gel process can be used for forming the dielectric layer since the sol-gel process can avoid the occurrence of cracking. Thus, the resulting dielectric layer can has a low dielectric constant of 5 or less. In other words, in addition to the prevention of a brightness decrease by the inhibition of a decrease in a light transmittance of the dielectric layer as described above, a low dielectric constant of the layer can be attained in view of the material, and thereby a high luminous efficiency is achieved, which will lead to a lower power consumption of PDPs.

DESCRIPTION OF REFERENCE NUMERALS

Figure 1:
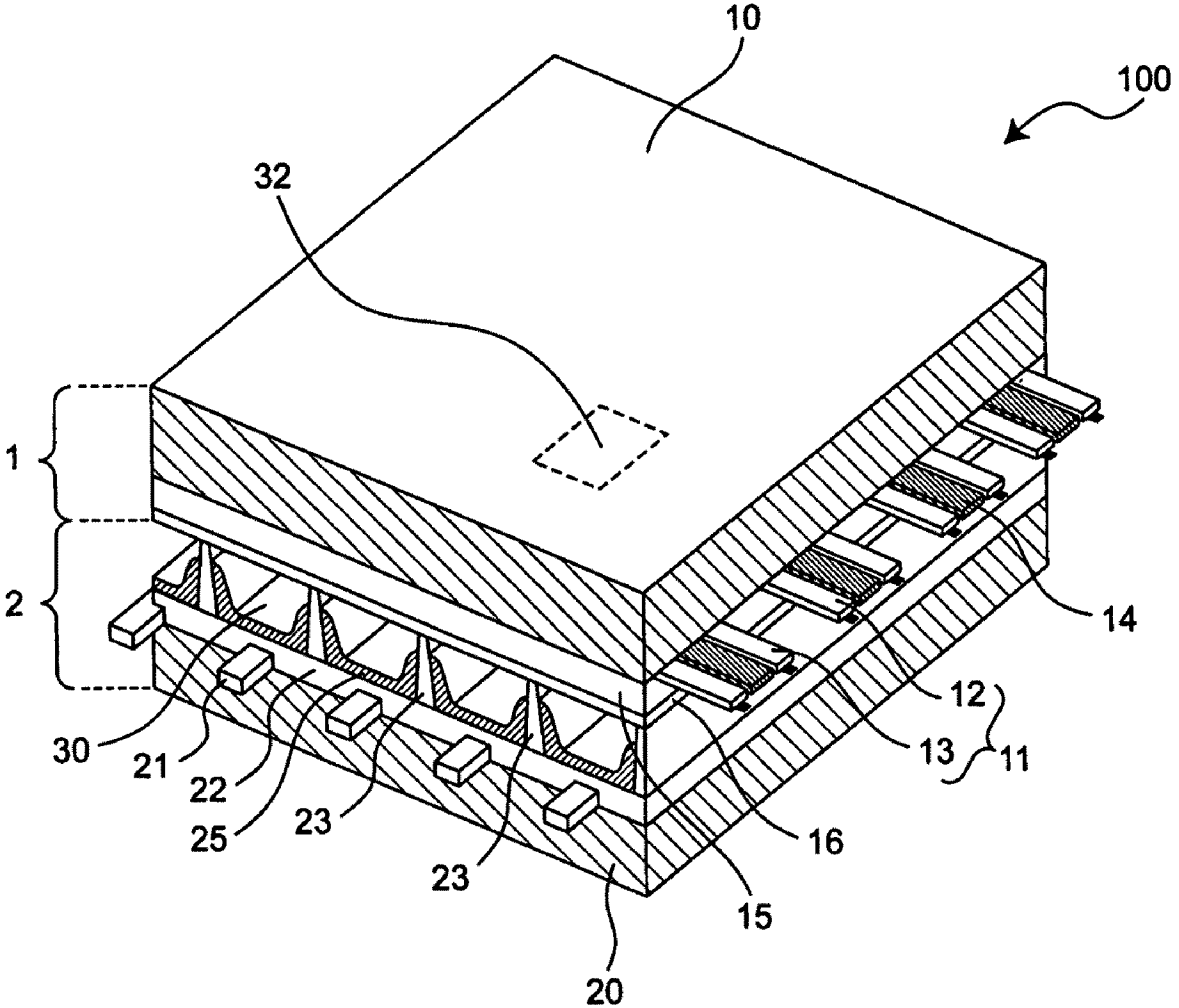
FIG. 1 is a perspective view schematically showing a structure of PDP according to an embodiment of the present invention.

1 . . . Front panel
2 . . . Rear panel (or Back panel)
10 . . . Substrate of front panel
11 . . . Electrode of front panel (Display electrode)
12 . . . Scan electrode
12*a* . . . Transparent electrode
12*b* . . . Bus electrode
13 . . . Sustain electrode
13*a* . . . Transparent electrode
13*b* . . . Bus electrode
14 . . . Black stripe (Light shielding layer)
15 . . . Dielectric layer of front panel
15*a* . . . Dielectric material layer
16 . . . Protective layer
20 . . . Substrate of rear panel
21 . . . Electrode of rear panel (Address electrode)
22 . . . Dielectric layer of rear panel
23 . . . Partition wall (Barrier rib)
25 . . . Phosphor layer (fluorescent layer)
30 . . . Discharge space
32 . . . Discharge cell
50 . . . Cracking
70 . . . Local glass layer
70*a* . . . Low-melting point frit material layer
100 . . . PDP

DETAILED DESCRIPTION OF THE PREFERRED EMBODIMENT

Hereinafter, a method for producing a plasma display panel according to the present invention will be described in detail.

[Construction of Plasma Display Panel]

First, a plasma display panel, which can be finally obtained by the method of the present invention, is described below. FIG. 1 schematically shows a perspective and sectional view of the construction of PDP.

Figure 4:
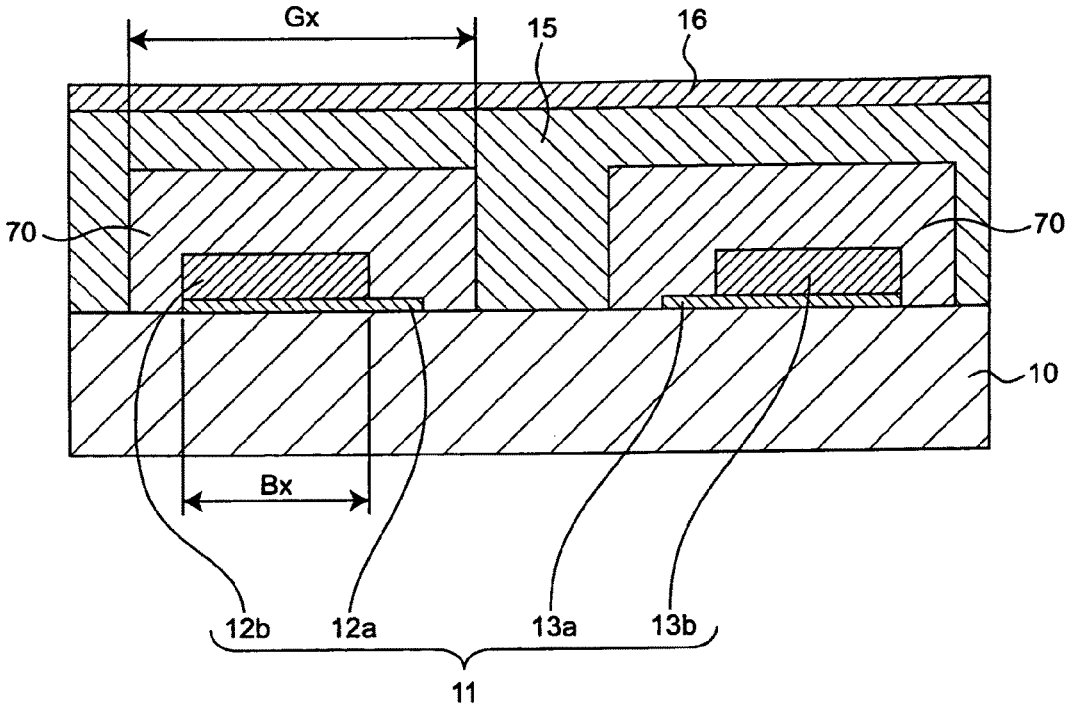
FIG. 4 is a sectional view schematically showing a PDP front panel obtained by a method of the present invention.

In a front panel (1) of PDP (100), a plurality of display electrodes (11) composed of a scan electrode (12) and a sustain electrode (13) are formed on a substrate (10). As the substrate (10), a smooth, transparent and insulating substrate (e.g. glass substrate) may be used. A dielectric layer (15) is formed over the substrate (10) so as to cover the display electrodes (11). A protective layer (16) (for example, protective layer made of MgO) is formed on the dielectric layer (15). Particularly as for the front panel of PDP obtained by the method of the present invention, local glass layers (70) are formed within the dielectric layer (15) such that each of the layers (70) encases each of the display electrodes (11) (see FIG. 4). As shown in FIG. 4, each of the scan electrode (12) and the sustain electrode (13) is composed of a transparent electrode (12*a*, 13*a*) and a bus electrode (12*b*, 13*b*) wherein the transparent electrode and the bus electrode are electrically interconnected. Optionally, there may be provided a light-shielding layer (14) on the substrate (10).

In a rear panel (2) arranged opposed to the front panel (1), a plurality of address electrodes (21) are formed on an insulating substrate (20). A dielectric layer (22) is formed over the substrate (20) so as to cover the address electrodes (21). A plurality of partition walls (23) are disposed on the dielectric layer (22) such that each walls (21) is located between the address electrodes (21). Phosphor layers (25) such as red, green and blue fluorescent layers are formed on a surface of the dielectric layer (22) such that each fluorescent layer is located between adjacent partition walls (23).

The front panel (1) and the rear panel (2) are opposed to each other while interposing the partition walls (23) such that the display electrode (11) and the address electrode (21) perpendicularly intersect with each other. Between the front panel and the rear panel, there is formed a discharged space filled with a discharge gas. As the discharged gas, a noble gas (e.g. helium, neon, argon or xenon) is used. With such a construction of the PDP (100), the discharge space (30) is divided by the partition walls (23). Each of the divided discharge space (30), at which the display electrode (11) and the address electrode (21) intersect with each other, serves as a discharge cell (32).

[General Method for Production of PDP]

Next, a typical production of the PDP (100) will be briefly described. The typical production of the PDP (100) comprises a step for forming the front panel (1) and a step for forming the rear panel (2).

As for the step for forming the front panel (1), the display electrode (11) is firstly formed on the glass substrate (10). Specifically, a transparent electrode is formed on the glass substrate (10) by a sputtering process, and subsequently a bus electrode is formed on the transparent electrode by a calcining process. Next, a dielectric material is applied over the glass substrate (10) so as to cover the display electrode (11), followed by a heat treatment thereof to form the dielectric layer (15). Next, the protective layer (16) is formed on the dielectric layer (15). Namely, a film made of MgO is provided by an electron-beam evaporation process (i.e. EB evaporation process).

As for the step for forming the rear panel (2), the address electrode (21) is firstly formed on the glass substrate (20) by a calcining process. Next, a dielectric material is applied over the glass substrate (20) so as to cover the address electrode (20), followed by a heat treatment thereof to form the dielectric layer (22). Subsequently, the partition walls (23) made of a low-melting point glass are formed in a form of predetermined pattern. Then a phosphor material is applied between the adjacent partition walls (23) and then calcined to form the phosphor layer (25). Next, a low-melting point frit glass material (namely, "sealing material to be used for panel sealing") is applied onto a periphery of the substrate (20) and then calcined to form a sealing component (not shown in FIG. 1).

After the front and rear panels are obtained, so-called panel sealing step is performed. Specifically, the front panel (1) and rear panel (2) are disposed opposed to each other and then heated in their fixed state to soften the sealing component therebetween. Such sealing step enables the front panel and the rear panel to be air-tight bonded with each other by the sealing component. After the sealing step, the discharge space (30) is vacuumed while heating thereof, followed by a filling of the discharge space (30) with the discharge gas. In this way, PDP (100) is finally obtained.

[Method of the Present Invention]

The method of the present invention particularly relates to a production of a front panel (more particularly a dielectric layer of the front panel) in the PDP production. The method of the present invention is characterized in that "local glass layer" and "entire dielectric layer" are formed on a substrate having an electrode formed thereon, and that a softening temperature of "local glass layer" is lower than and equal to a softening temperature of a panel sealing material.

Figure 2:
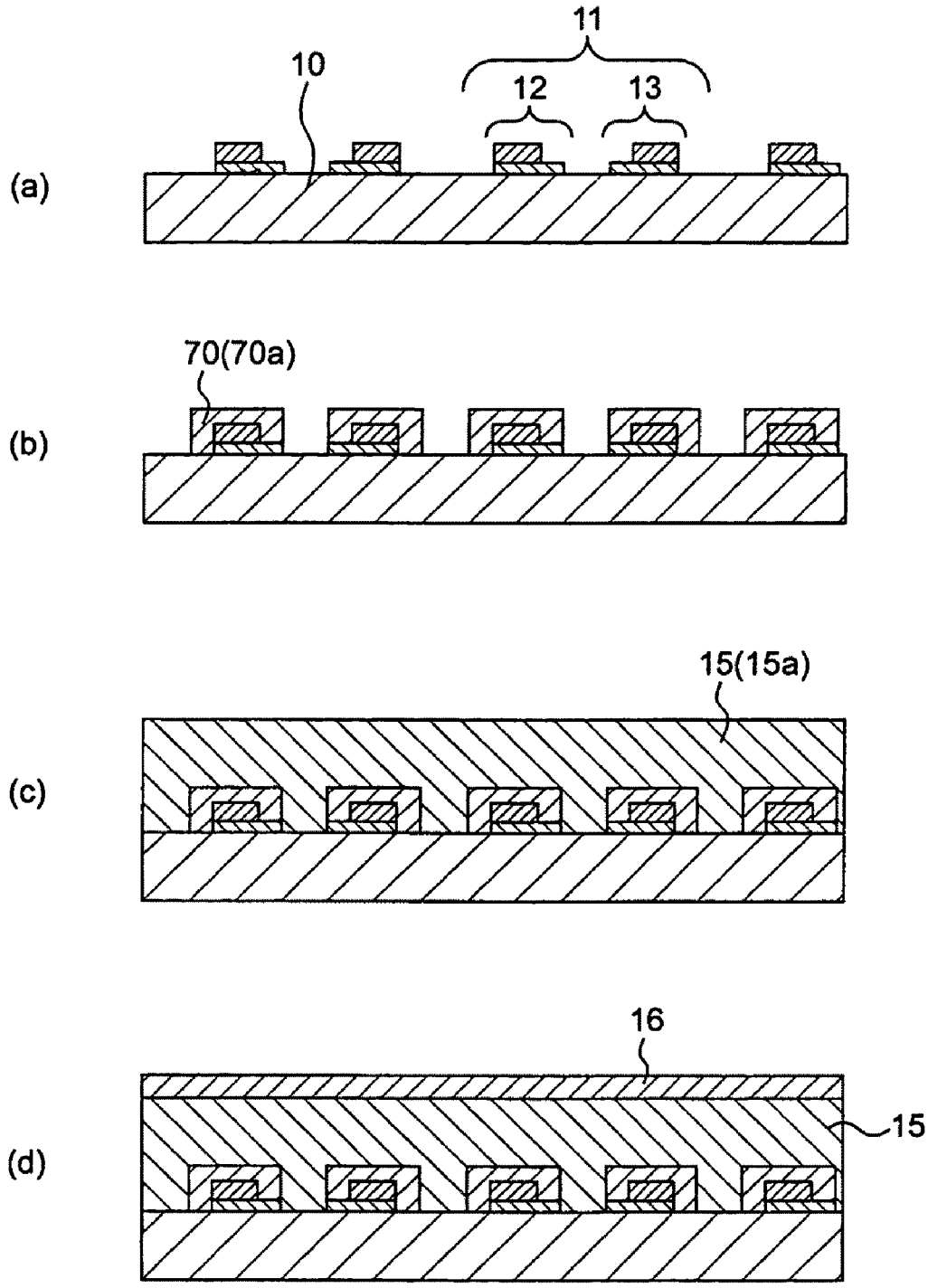
FIG. 2 is a sectional view schematically showing the steps in a method of the present invention.

Referring to FIG. 2, an embodiment of the present invention will be described. Upon carrying out the present invention, firstly, a substrate with an electrode formed thereon as shown in FIG. 2(*a*) is prepared. Namely, the substrate and the electrode formed a principal surface thereof are prepared. The substrate with the electrode is, for example, a glass substrate with a display electrode formed thereon. Specifically, there is prepared a glass substrate (10) on which a display electrode (11) composed of a scan electrode (12) and a sustain electrode (13) is formed. The substrate (10) itself is preferably an insulating substrate made of soda-lime glass, high-strain point glass or various kinds of ceramics. It is preferred that the thickness of the substrate (10) is in the range of from about 1.0 mm to 3 mm. As each of the scan electrode (12) and the sustain electrode (13) of the display electrode (11), a transparent electrode made of ITO (about 50 nm to 500 nm in thickness) (12*a*, 13*a*) is provided, and also a bus electrode made of silver (about 1 μm to 8 μm in thickness) (12*b*, 13*b*) is provided on the transparent electrode to decrease the resistance value of the display electrode (see FIG. 4). Specifically, the transparent electrode is formed by a thin film process, and subsequently the bus electrode is formed by a calcining process. Particularly upon the formation of the bus electrode, first, a conductive paste containing silver as a main component is supplied in a form of stripes by a screen printing process so as to form a bus electrode precursor. Alternatively, the bus electrode precursor may be formed in a form of stripes by patterning it using photolithography wherein a photosensitive paste which mainly contains silver is applied by a die coating process or a printing process, and then dried at 100° C. to 200° C., followed by exposure and developing thereof. Moreover, the bus electrode precursor may be formed by a dispensing process or an ink-jet process. The resulting bus electrode precursor is dried and then finally calcined at 400° C. to 600° C. to form a buy electrode therefrom. It should be noted that the thermal expansion coefficient of the display electrode (11) may be about $64\times10^{-7}$ [/° C.].

Subsequently, the step (i) is performed. Namely, a low-melting point frit material layer (70*a*) is locally formed by supplying a low-melting point frit material onto a predetermined local region of the substrate (10) having the display electrode (11) thereon. Specifically, the low-melting point frit material is applied such that the applied material covers each of the display electrodes (11), and thereby a plurality of the low-melting point frit material layers (70*a*) are locally formed, as shown in FIG. 2(*b*).

The low-melting point frit material preferably comprises a low-melting point glass frit and a vehicle (=organic solvent+binder resin). The low-melting point glass frit substantially means a glass frit with a glass transition point of about 300° C. to 400° C. Therefore, it will be understood that the phrase "low-melting point" as used herein substantially means a glass transition point ranging from about 300° C. to about 400° C. Examples of the low-melting point glass frit include, but are not limited to, $PbO—SiO_2—B_2O_3$-based glass frit, $PbO—P_2O_5—SnF_2$-based glass frit and $PbF_2—SnF_2—SnO—P_2O_5$-based glass frit. The low-melting point glass frit may be a lead-free glass frit, for example, $B_2O_3—ZnO—SiO_2$-based glass frit.

As the organic solvent contained in the vehicle, isoamyl acetate is preferably used, but the present invention is not limited to that. Examples of the organic solvent include alcohols such as methanol, ethanol, propanol, isopropyl alcohol, butanol and isobutyl alcohol; ketones such as methyl ethyl ketone and methyl isobutyl ketone (MIBK); terpenes such as α-terpineol, β-terpineol and γ-terpineol; ethylene glycol monoalkyl ethers; ethylene glycol dialkyl ethers; diethylene glycol monoalkyl ethers; diethylene glycol dialkyl ethers; ethylene glycol monoalkyl ether acetates; ethylene glycol dialkyl ether acetates; diethylene glycol monoalkyl ether acetates; diethylene glycol dialkyl ether acetates; propylene glycol monoalkyl ethers; propylene glycol dialkyl ethers; and propylene glycol monoalkyl ether acetates. These organic solvents can be used alone, but it is possible to suitably combine the above organic solvents with each other.

As the binder resin contained in the vehicle, ethyl cellulose-based resin is preferably used, but the present invention is not limited to that. Examples of the binder resin include polyvinyl alcohol, polyvinyl butyral, methacrylic acid ester polymer, acrylic acid ester polymer, acrylic acid ester-methacrylate ester copolymer, α-methylstyrene polymer and butyl methacrylate resin. These binder resins can be used alone, but it is possible to suitably combine the above binder resins with each other.

The low-melting point frit material may optionally comprises a filler. As the filler, for example, lead titanate, zirconiumn silicate, beta-eucryptite, cordierite and willemite may be used. Use of the filler can make the thermal expansion coefficient of the low-melting point frit material to be closer to the thermal expansion coefficient of the substrate. Accordingly, it becomes possible to additionally prevent or reduce the cracking phenomenon attributable to a difference in the thermal expansion coefficients.

The contents of the components contained in the low-melting point frit material are not particularly limited as long as the formation of the local glass layer can be achieved. Just as an example, however, in a case where the low-melting point frit material consists of a low-melting point glass frit and a vehicle (=Organic solvent+binder resin), the content of the low-melting point glass frit may be in the range of from about 60% by weight to about 90% by weight, the content of the organic solvent may be in the range of from about 5.0% by weight to about 40% by weight, and the content of the binder resin may be in the range of from about 0.1% by weight to about 5.0% by weight. The low-melting point frit material used in the method of the present invention is preferably used in the form of a paste. It is thus preferred that the viscosity of the low-melting point frit material is in the range of from about 3 mPa·s to 50 Pa·s at room temperature (i.e. 25° C.).

The low-melting point frit material can be applied by a dispensing process. In the dispensing process, a paste material is charged into a cylindrical vessel equipped with a small-diameter nozzle, and then the paste material is discharged therefrom by applying an air pressure to an aperture portion opposed to the nozzle. According to this dispensing process, the discharged amount of the paste material can be controlled by adjusting the air pressure and a pressurization time thereof.

Alternatively, the low-melting point frit material can be applied by a die coating process. The die coating process is performed by discharging a paste material through a slit of a die head, while moving the die head or the substrate in the direction of an application. The die coating process is suitable for forming a thick film of the paste material. With respect to the present invention, the dielectric material paste is charged into a closed vessel (e.g. tank). The dielectric material paste is then supplied to a syringe pump from the vessel through a piping by pressurizing the inside of the vessel, followed by the supply of the dielectric material paste to the die head by mechanical force of the syringe pump. In order to stabilize the thickness of the applied film, a manifold is preferably disposed in the die head to make the paste material pressure attributable to the supplying force uniform along the direction of application width. Since an internal pressure until the dielectric material paste is discharged through the slit of the die head is not directly transmitted at the starting portion upon initiation of application, the thickness and shape of the film are controlled by partially adjusting the application rate. At the ending portion upon completion of the application, the thickness and shape of the film are controlled by stopping the supply of the paste through the termination of the mechanical force of the syringe pump. Since the internal pressure of the paste does not disappear immediately after the termination of mechanical force of the syringe pump, it is preferred that a piping valve for reducing the internal pressure is actuated and also the die head is moved upward immediately after the completion of the application so as to stabilize the film shape of the ending portion by cutting the paste with a shear stress thereof. Alternatively, the low-melting point frit material may be applied by a printing process, a photolithography process or the like.

Figure 3:
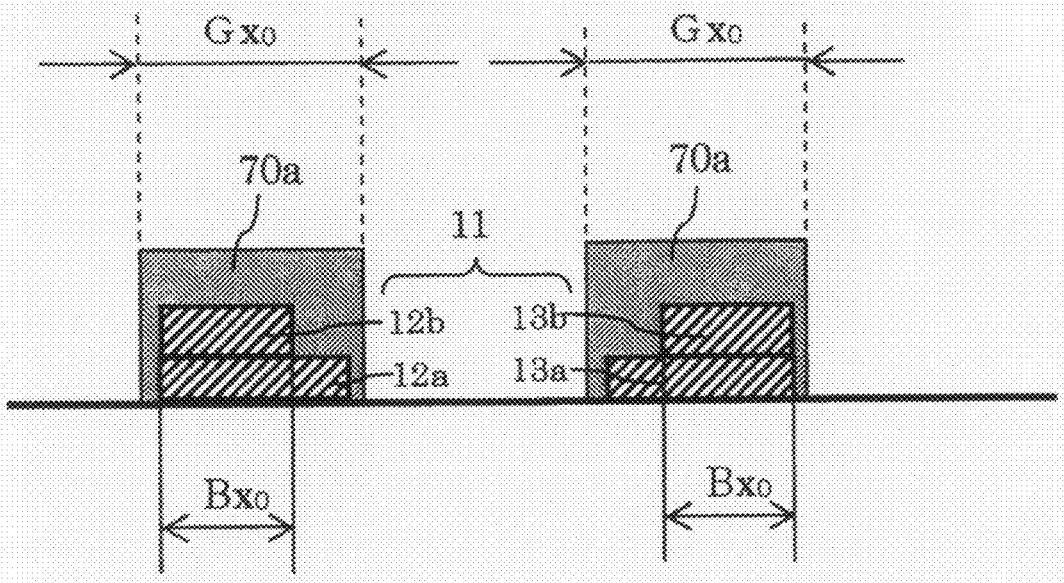
FIG. 3 is a sectional view schematically showing an embodiment obtained after performing the step (i) of a method of the present invention.

It is preferred that the low-melting point frit material is locally applied so as to cover each of display electrodes (11) formed on the substrate. More preferably, the low-melting point frit material is locally applied such that it encases or encloses a bus electrode (12*b*, 13*b*) of each display electrode (11) (namely, the low-melting point frit material is applied along the bus electrode). As shown in FIG. 3, in view of the following (1) and (2), it is preferred that $Gx_0$ and $Bx_0$ satisfy the relation: $1 \leqq Gx_0/Bx_0 \leqq 2$ where $Gx_0$ denotes a width of a low-melting point frit material layer (70*a*) and $Bx_0$ denotes a width of a bus electrode (12*b*, 13*b*) of a display electrode (the term "width" as used herein substantially means a width along a cross-section obtained by cutting PDP along a vertical direction as shown in the drawing).

Figure 6:
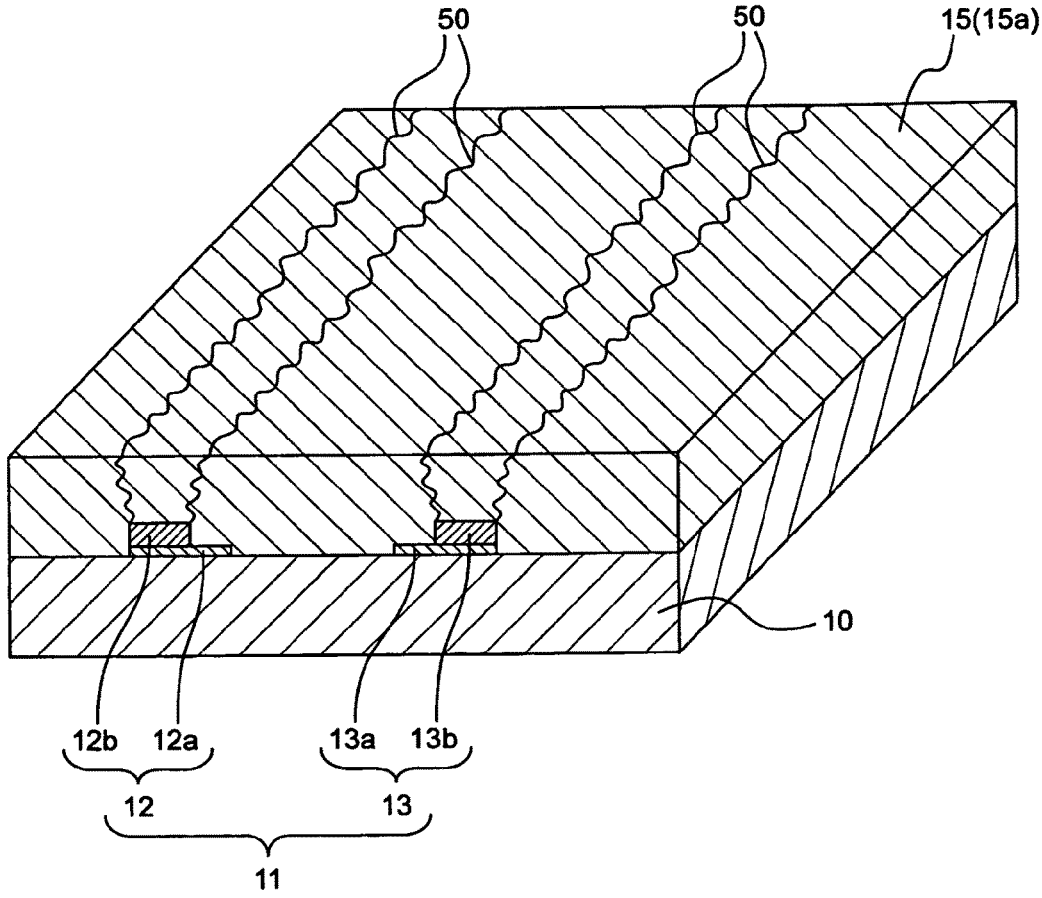
FIG. 6 is a perspective view schematically showing a cracking phenomenon which may occur in a dielectric layer.
Figure 7:
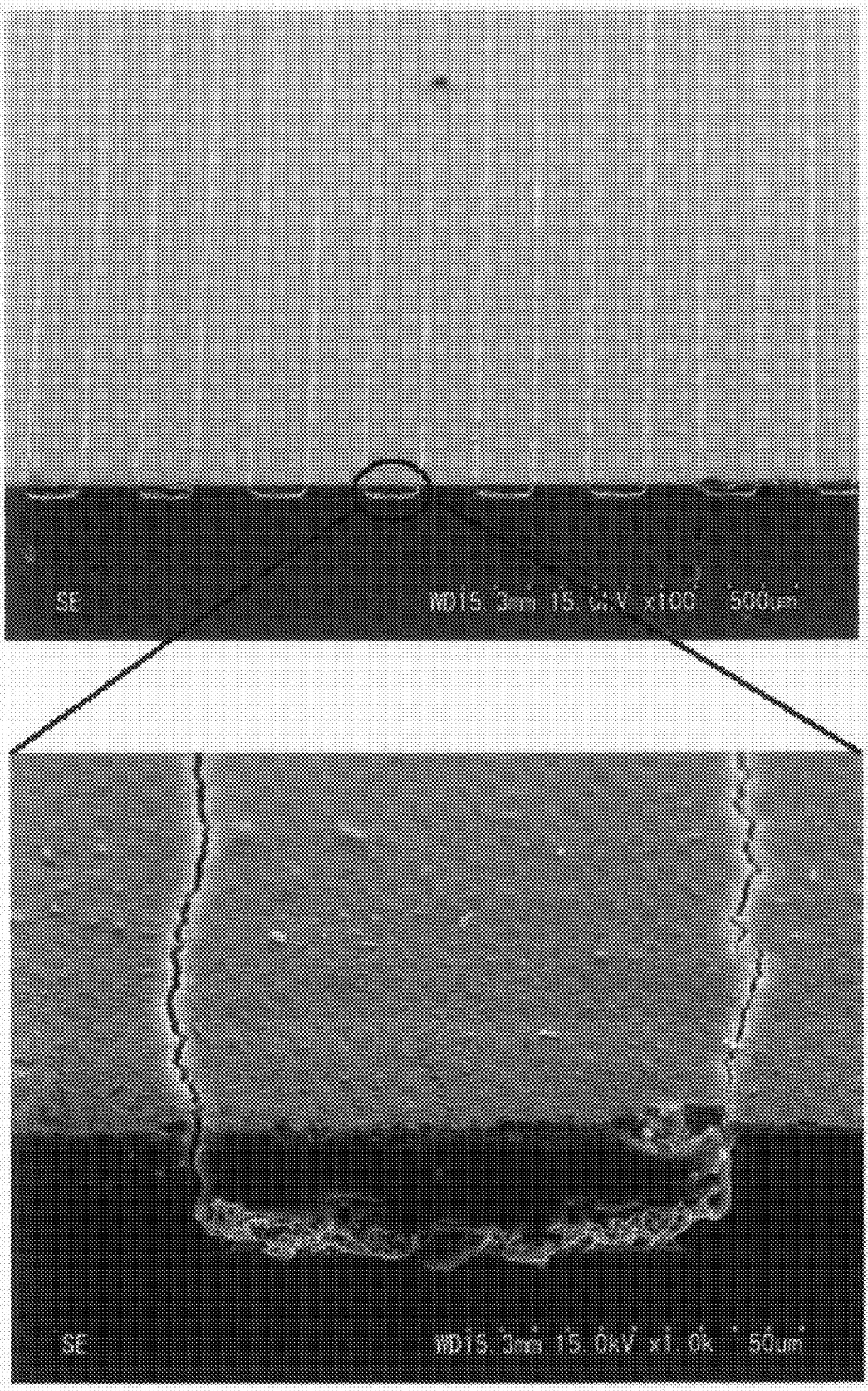
FIG. 7 is an electron micrograph of a cracking which have occurred in a dielectric layer.

(1) The cracking attributable to the condensation polymerization reaction after the formation of the dielectric layer tends to occur along edge of each display electrode (see FIG. 6 and FIG. 7). The stress concentration adjacent to the edge portion of the electrode can not be reduced or relaxed when $Gx_0/Bx_0$ is less than 1. Namely, the occurrence of the cracking cannot be effectively prevented when $Gx_0/Bx_0$ is less than 1.

(2) On the other hand, when $Gx_0/Bx_0$ is more than 2, the brightness tends to decrease by the existence of the local glass layer formed from a low-melting point frit material layer. The decrease of the brightness means the decrease of the luminous efficiency, and thus the effect of a low dielectric constant material is offset thereby.

The thickness of the low-melting point frit material layer is preferably in the range of from 5 to 60 μm, and more preferably in the range of from 10 to 20 μm. Subsequent to the step (i), the step (ii) is performed. Namely, the low-melting point frit material layer (70*a*) is heated to form a local glass layer (70) from the material layer (70*a*). The heat treatment preferably includes a drying treatment and a calcining treatment. In this case, it is preferred that the drying treatment is carried out and then the calcining treatment is carried out. In the drying treatment, the low-melting point frit material layer is preferably dried at 60° C. to 200° C. for 0.1 to 2 hours. In the calcining treatment, the low-melting point frit material layer is preferably calcined at 300° C. to 600° C. for 0.1 to 2 hours. As heat treatment means, a heating chamber (e.g. calcining furnace) may be used, for example. In this case, the low-melting point frit material layer (70*a*) can be heated by placing "substrate with a display electrode and a low-melting point frit material layer formed thereon" obtained from the step (i) within the heating chamber. The thermal expansion coefficient of the glass layer (70) formed by the heat treatment may be about $70\times10^{-7}$ [/° C.], for example.

Subsequent to the step (ii), the step (iii) is performed. Namely, a dielectric material is entirely supplied onto "substrate with the display electrode (11) and the glass layer (70) formed thereon" to form a dielectric material layer (15*a*) therefrom (see FIG. 2(*c*)). Specifically, a dielectric material paste is applied onto "substrate with the display electrode (11) and the glass layer (70) formed thereon" by a die coating process to form a dielectric material layer (15*a*) which covers the display electrode (11) and the glass layer (70) on the substrate (10). The thickness of the dielectric material layer (15*a*) is preferably in the range of from 5 to 30 μm, and more preferably in the range of from 10 to 20 μm. The term "thickness" as used herein substantially means a distance from a surface of the substrate to a top face of the dielectric material layer.

The dielectric material (preferably dielectric material paste) to be used in the method of the present invention comprises a glass component and an organic solvent.

The glass component of the dielectric material is preferably a component which contains a silicon compound, and more preferably a component which contains a compound with a siloxane bond (or siloxane backbone). The compound with a siloxane bond (or siloxane backbone) may be a low molecular weight to high molecular weight-compound with Si—O bond, and such compound may be an inorganic compound or an organic compound. Examples of the glass component include, but are not limited to, $Si(OC_2H_5)_4$ (TEOS: tetraethyl orthosilicate), methyltrimethoxysilane, methyltriethoxysilane, methyltriisopropoxysilane, ethyltrimethoxysilane, ethyltriethoxysilane, ethyltriisopropoxysilane, octyltrimethoxysilane, octyltriethoxysilane, vinyltrimethoxysilane, vinyltriethoxysilane, phenyltrimethoxysilane, phenyltriethoxysilane, trimethoxysilane, triethoxysilane, triisopropoxysilane, fluorotrimethoxysilane, fluorotriethoxysilane, dimethyldimethoxysilane, dimethyldiethoxysilane, diethyldimethoxysilane, diethyldiethoxysilane, dimethoxysilane, diethoxysilane, difluorodimethoxysilane, difluorodiethoxysilane, trifluoromethyltrimethoxysilane, trifluoromethyltriethoxysilane, silicon carbide (SiC), other alkoxide-based organic silicon compounds ($Si(OR)_4$), for example, tetratertiary butoxysilane (t-$Si(OC_4H_9)_4$), tetra secondary butoxysilane sec-$Si(OC_4H_9)_4$, tetratertiary amyloxysilane $Si[OC(CH_3)_2C_2H_5]_4$, and polymer compounds obtained by hydrolysis and condensation polymerization of these compounds.

Examples of the organic solvent of the dielectric material include, but are not limited to, alcohols such as methanol, ethanol, propanol, isopropyl alcohol, butanol and isobutyl alcohol; ketones such as methyl ethyl ketone and methyl isobutyl ketone (MIBK); terpenes such as α-terpineol, β-terpineol and γ-terpineol; ethylene glycol monoalkyl ethers; ethylene glycol dialkyl ethers; diethylene glycol monoalkyl ethers; diethylene glycol dialkyl ethers; ethylene glycol monoalkyl ether acetates; ethylene glycol dialkyl ether acetates; diethylene glycol monoalkyl ether acetates; diethylene glycol dialkyl ether acetates; propylene glycol monoalkyl ethers; propylene glycol dialkyl ethers; and propylene glycol monoalkyl ether acetates. These organic solvents can be used alone, but it is possible to suitably combine the above organic solvents with each other. Since it is desired that the organic solvent is vaporized by the heat treatment performed in the present invention, an organic solvent with a boiling point of about 300° C. or lower is preferably used.

The dielectric material (preferably dielectric material paste) used in the method of the present invention may optionally comprise a binder resin. Examples of the binder resin include polyvinyl alcohol, polyvinyl butyral, methacrylate ester polymer, acrylate ester polymer, acrylate ester-methacrylate ester copolymer, α-methylstyrene polymer, butyl methacrylate resin and cellulose-based resin. These binder resins can be used alone, but it is possible to suitably combine the above binder resins with each other.

The dielectric material used in the method of the present invention is preferably used in the form of a paste. It is thus preferred that the viscosity of the dielectric material is in the range of from about 3 mPa·s to 50 Pa's at room temperature (i.e. 25° C.).

The contents of the components contained in the dielectric material are not particularly limited as long as it is usual contents used to obtain a typical dielectric layer of PDP (more specifically, as long as it is usual contents used to form a dielectric layer by a sol-gel process). Just as an example, however, in a case where the dielectric material consists of a glass component and an organic solvent, the content of the glass component is preferably in the range of from 20% by weight to 80% by weight, and the content of the organic solvent is preferably in the range of from 20% weight to 80% by weight. The content of the glass component is more preferably in the range of from 40% by weight to 60% by weight, and the content of the organic solvent is more preferably in the range of from 40% by weight to 60% by weight. In a case where the dielectric material consists of a glass component, an organic solvent and a binder resin, the content of the glass component may be about 55% by weight, the content of the organic solvent may be about 40% by weight and the content of the binder resin may be about 5% by weight.

Subsequent to the step (iii), the step (iv) is performed. Namely, a dielectric material layer (15*a*) is heated to form a dielectric layer (15) from the material layer (15*a*). When the dielectric material layer (15*a*) is heated, the condensation polymerization reaction proceeds in the dielectric material layer (15*a*) to form the dielectric layer (15). The heating temperature of the step (iv) is determined by various factors such as the boiling point and content of the organic solvent in addition to heat quantity required for the condensation polymerization reaction. In general, the heating temperature of the step (iv) is preferably in the range of from about 100° C. to about 300° C., and preferably in the range of from about 100° C. to about 200° C. The heating time of the step (iv) is determined by comprehensively considering heat quantity required for the condensation polymerization reaction, boiling point and content of the solvent of the dielectric material. In other words, a preferable heating time of the step (iv) varies depending on the kind of the dielectric material. Just as an example, however, the heating time of the step (iv) is preferably in the range of from about 5 minutes to 120 minutes, and more preferably in the range of from about 10 minutes to 60 minutes. As a heat treatment means, a heating chamber (e.g. calcining furnace) may be used, for example. In this case, the dielectric material layer can be entirely heated by placing "substrate with the display electrode, the glass layer and the dielectric material layer formed thereon" obtained from the step (iii) within the heating chamber. The thermal expansion coefficient of the dielectric layer (15) formed by the heat treatment may be about $30\times10^{-7}$ [/° C.], for example.

After forming the dielectric layer (15) by the step (iv), a protective layer (16) is formed. Namely, a film (16) made of MgO is formed on the dielectric layer (15) by a vacuum deposition process or an electron-beam evaporation process (EB evaporation process) (see FIG. 2(*d*)). The protective layer (16) may be made of beryllium oxide (BeO), calcium oxide (CaO), strontium oxide (SrO) or barium oxide (BaO), not limiting to magnesium oxide (MgO). The protective layer may also be formed by a heating CVD process, plasma CVD process or sputtering process.

By performing the above steps (i) to (iv) as described above, a front panel of the PDP can be finally obtained.

[Dielectric Layer of Front Panel of PDP]

In the front panel of PDP obtained by the present invention, there exists "glass layer (70) formed locally on a bus electrode" and "dielectric layer (15) formed entirely on a substrate". Particularly, as shown in FIG. 4, it is preferred that Gx and Bx satisfy the relation: $1 \leqq Gx/Bx \leqq 2$ where Gx denotes a width of a local glass layer (70) and Bx denotes a width of a bus electrode (12*b*, 13*b*) of a display electrode (the term "width" as used herein substantially means a width along a cross-section obtained by cutting PDP along a vertical direction as shown in the drawing). Since the width Bx of the bus electrode is preferably in the range of from 30 to 80 μm, the width Gx of the locally formed glass layer is preferably in the range of from 30 to 160 μm. The above relation will lead to an achievement of a desired balance between "beneficial aspect wherein an occurrence of a cracking phenomenon is prevented by the glass layer" and "adverse aspect wherein a light transmittance is decreased by the glass layer".

According to the present invention, a softening temperature of the glass layer (70) of the PDP front panel is not higher than a softening temperature of the sealing material used for a panel sealing by which the front panel and a rear panel are sealed with each other. In other words, the softening temperature of the sealing material used for panel sealing (for example, low-melting point frit for sealing) is in the range of from about 430° C. to 500° C., and thus the glass layer (70) has the softening temperature lower than the softening temperature of the sealing material. For example, the softening temperature of the glass layer (70) is in the range of from 400° C. to 500° C. or lower. Thereby, due to the panel sealing temperature, the glass layer (70) can be once softened. As a result, even if the panel sealing temperature causes the uncompleted condensation polymerization reaction to proceed additionally or concomitantly in the dielectric layer, the softened glass layer (70) can effectively prevent the cracking phenomenon from occurring. It should be noted that the cracking phenomenon generally may be induced by the condensation polymerization reaction of the dielectric layer. The phrase "softening temperature" as used herein substantially means a temperature at which the glass layer (70) or the sealing material begins to change from its hard state into a soft state. For example, the softening temperature is a Vicat softening point measured in accordance with JIS K7206.

In a different viewpoint from "softening of the glass layer upon sealing", it is preferred that the softening temperature of the glass layer (70) is not lower than a solidification temperature of the dielectric material. In other words, the solidification temperature of the dielectric material layer (15*a*) is in the range from about 200 to 400° C., whereas the glass layer (70) preferably has the softening temperature higher than the solidification temperature of the dielectric material layer (15*a*). For example, the softening temperature of the glass layer (70) is in the range of from 200° C. to 400° C. and higher. Thereby, even if an alkyl group with the stress releasing effect is eliminated or released from the dielectric material layer (15*a*) or dielectric layer (15) by an excess heating thereof (i.e. heating at a temperature condition higher than the solidification temperature upon a panel sealing or a formation of protective layer), a buffer or cushion action of the softened glass layer can effectively prevent the cracking from occurring. The phrase "solidification temperature" as used herein substantially means a temperature at which a solidification of the dielectric material layer is initiated due to the condensation polymerization reaction.

Based on the above "not higher than the softening temperature of the sealing material" and "not lower than the solidification temperature of the dielectric material", the softening temperature of the glass layer (70) is preferably in the range of from 200 to 500° C., and more preferably in the range of from 300 to 400° C.

In the present invention, the dielectric layer of the front panel can be formed by a so-called sol-gel process. This means that the dielectric layer can have a lower dielectric constant. For example, the dielectric constant of the dielectric layer is preferably not higher than 5. Accordingly, a generation efficiency of ultraviolet ray is improved so that a low power consumption of the PDP is achieved. The dielectric constant as used herein means a value of the dielectric constant measured at 23° C. and 1 MHz.

In the PDP obtained by the method of the present invention, the thermal expansion coefficient of the display electrode (11) is about $64\times10^{-7}$ [/° C.], the thermal expansion coefficient of the glass layer (70) is about $70\times10^{-7}$ [/° C.], and the thermal expansion coefficient of the dielectric layer (15) is about $30\times10^{-7}$ [/° C.]. Therefore, in one preferred embodiment, the thermal expansion coefficient of the glass layer is larger than those of the display electrode and the dielectric layer.

The present invention has been hereinabove described with reference to preferred embodiments. It will be however understood by those skilled in the art that the present invention is not limited to such embodiments and can be modified in various ways. For example, although the method of the present invention is mainly suited for forming a dielectric layer of the front panel, but may be used for forming a dielectric layer of the rear panel and the similar effect can be provided even in this case. Also, the local glass layer not only effectively prevent or reduce the cracking that may occur after the formation of the dielectric layer, but also effectively can prevent or reduce the cracking that may occur upon formation of the dielectric layer.

EXAMPLES

As an example, a front panel comprising a local glass layer and a dielectric layer was produced, and then characteristics thereof were studied.

(Low-Melting Point Frit Paste)

A low-melting point frit paste with the following composition and physical properties was used for forming a local glass layer.

Low-melting point glass component (80% by weight): Lead-free low-melting point glass frit containing $B_2O_3$—ZnO—$SiO_2$ Vehicle (20% by weight): Mixture of a cellulose-based resin and an alkyl acetate solvent (Dielectric Material Paste)

A dielectric material paste with the following composition and physical properties was used for forming a dielectric layer.

Glass component (20% by weight): Polysiloxane oligomer obtained from TEOS and the like Organic solvent component (80% by weight): Methanol, isopropyl alcohol, α-terpineol Viscosity of dielectric material paste: 5 mPa·s (25° C.)

(Production of Front Panel)

First, a transparent electrode made of ITO (0.12 mm in width and 100 nm in thickness of the transparent electrode) was formed on a surface of 1.8 mm thick glass substrate (i.e. soda-lime glass, manufactured by Nippon Electric Glass Co., Ltd.) and subsequently a bus electrode made of Ag (0.065 mm in width and 6 μm in thickness of the bus electrode) was formed on the transparent electrode. Next, a low-melting point frit paste was applied over each of the bus electrodes by a dispensing process to form low-melting point frit material layers. Subsequently, the low-melting point frit material layers were dried at 100° C. and then calcined at 450° C. to form local glass layers. Since the width of the local glass layer was 0.1 mm, "width of the local glass layer"/"width of the bus electrode" was nearly equal to 1.5. Next, a dielectric material paste was entirely applied over the glass substrate by a die coating process to form a dielectric material layer with 0.015 mm thickness thereof. Subsequently, the glass substrate provided with the electrodes, the glass layers and the dielectric material layer was placed into a heating furnace having an interior temperature of 250° C. As a result, the dielectric material layer was heated at a temperature increase rate of 20° C./minutes, and thereby allowing the condensation polymerization reaction of a polysiloxane oligomer to proceed in the dielectric material layer to form a dielectric layer. The resulting dielectric layer included the glass layers which had locally formed over the electrodes. Finally, as a protective layer, a film made of MgO was formed on the dielectric layer by an electron-beam evaporation process, and thereby completing the production of the front panel.

(Characteristics of Dielectric Layer and Glass Layer)

Characteristics and specification of the dielectric layer thus formed were as follows:

Dielectric constant: 3.6 (Meter Model KC-555 manufactured by Kokuyo Electric Co., Ltd.)

Light transmittance: 81% (Haze meter, HM-150, manufactured by MURAKAMI COLOR RESEARCH LABORATORY CO., Ltd.)

Physical defects: No cracking along the electrode was observed.

Softening temperature of glass layer: 400° C.

Based on the above examples, it will be appreciated that the cracking of the dielectric layer can be prevented by the low-melting point frit layers formed over the electrodes, while a decrease in a light transmittance of the dielectric layer caused by the low-melting point frit layer can be also prevented. It will be also appreciated that the local glass layers can be once softened due to the panel sealing temperature since the softening temperature of the glass layers is 400° C. which is not higher than the softening temperature of the sealing material used for panel sealing. Therefore, it will be further appreciated that, even if the panel sealing temperature causes the uncompleted condensation polymerization reaction to proceed additionally or concomitantly in the dielectric layer, the cracking phenomenon induced by such reaction can be effectively prevented.

Figure 5:
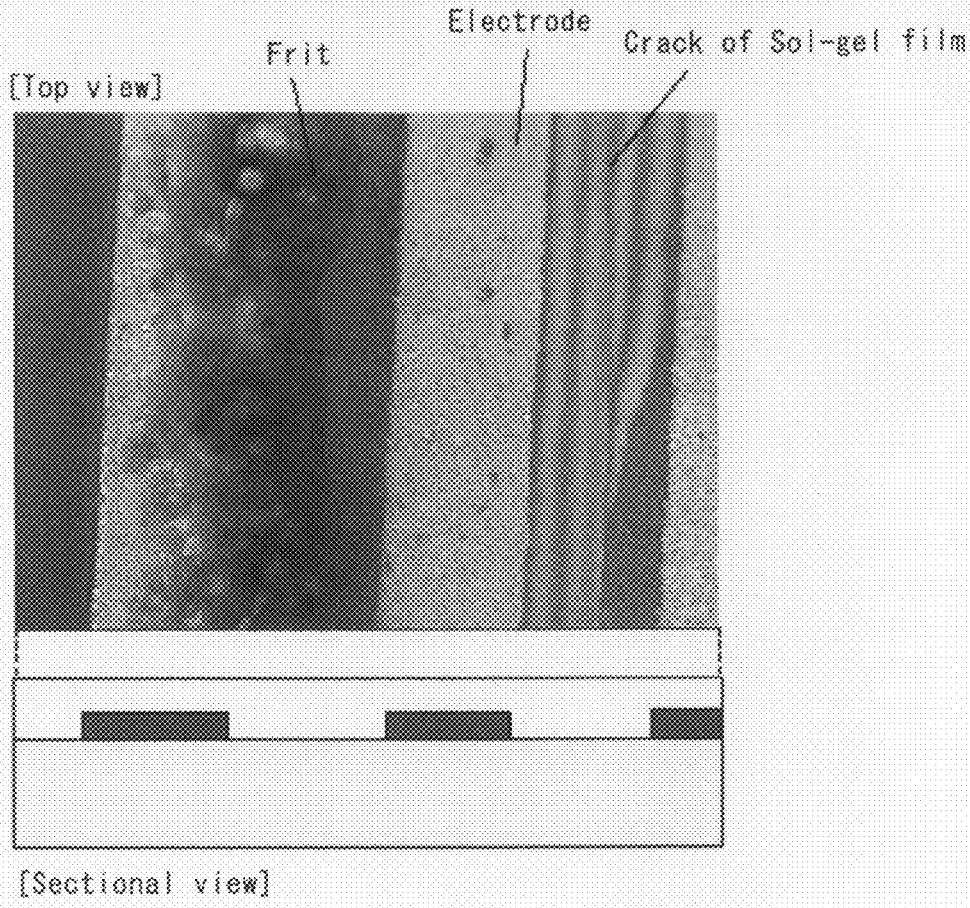
FIG. 5 is a photograph taken in a "test of applying a frit onto an electrode".

For reference, a photographic image obtained in a "test of applying a frit onto an electrode" which was additionally performed is shown in FIG. 5. Such test was performed so as to confirm a prevention of the cracking in the dielectric layer. The result of this test has revealed that the existence of a local glass layer is effective to prevent the cracking of the dielectric layer.

INDUSTRIAL APPLICABILITY

The PDP obtained by the method of the present invention has low power consumption, and thus it is not only suitable for household use and commercial use, but also suitable for use in other various kinds of display devices.

What is claimed is:

1. A method for producing a plasma display panel comprising a front panel wherein an electrode, a dielectric layer and a protective layer are formed on a substrate of the front panel, a formation of the dielectric layer comprising:

(i) locally supplying a low-melting point frit material onto a predetermined region of the substrate having the electrode thereon to locally form a low-melting point frit material layer;

(ii) heating the low-melting point frit material layer to form a local glass layer therefrom;

(iii) supplying a dielectric material over the substrate, covering the electrode and the local glass layer therewith to form a dielectric material layer; and (iv) heating the dielectric material layer to form a dielectric layer therefrom, wherein a softening temperature of the local glass layer is lower than or equal to a softening temperature of a sealing material to be used for a panel sealing by which the front panel is sealed with a rear panel.

2. The method according to claim 1, wherein the softening temperature of the local glass layer is higher than or equal to a solidification temperature of the dielectric material.

3. The method according to claim 1, wherein the predetermined region is a local substrate region whereon the electrode is at least formed; and the local glass layer encases the electrode on the substrate.

4. The method according to claim 3, wherein a width Gx of the local glass layer and a width Bx of a bus electrode of the electrode meet the condition: $1 \leqq Gx/Bx \leqq 2$.

* * * * *